US010160256B2

(12) United States Patent
Schempp et al.

(10) Patent No.: US 10,160,256 B2
(45) Date of Patent: Dec. 25, 2018

(54) INSERTER AND METHOD FOR OPENING AN ENVELOPE THROAT OF AN ENVELOPE TRANSPORTED ALONG AN ENVELOPE CHANNEL

(71) Applicant: Boewe Systec GmbH, Augsburg (DE)

(72) Inventors: Harald Schempp, Ulm (DE); Manfred Ziegler, Hiltenfingen (DE); Torsten Paessler, Obergriessbach (DE)

(73) Assignee: Boewe Systec GmbH, Augsburg (DE)

( * ) Notice: Subject to any disclaimer, the term of this patent is extended or adjusted under 35 U.S.C. 154(b) by 985 days.

(21) Appl. No.: 14/132,511

(22) Filed: Dec. 18, 2013

(65) Prior Publication Data

US 2014/0196414 A1 Jul. 17, 2014

Related U.S. Application Data

(60) Provisional application No. 61/740,148, filed on Dec. 20, 2012.

(51) Int. Cl.

| | |
|---|---|
| ***B65B 43/34*** | (2006.01) |
| ***B65B 57/04*** | (2006.01) |
| ***B65B 5/04*** | (2006.01) |
| ***B65H 5/00*** | (2006.01) |
| ***B43M 3/04*** | (2006.01) |
| ***B43M 3/00*** | (2006.01) |
| ***B43M 7/00*** | (2006.01) |

(52) U.S. Cl.

CPC ..... *B43M 3/045* (2013.01); *B43M 3/00* (2013.01); *B43M 7/004* (2013.01)

(58) Field of Classification Search

CPC .. B65B 5/04; B65B 57/04; B65H 5/00; B68B 43/34

USPC ..... 53/460, 384, 35, 67, 71, 186, 569, 266, 53/571

See application file for complete search history.

(56) References Cited

U.S. PATENT DOCUMENTS

| | | | | |
|---|---|---|---|---|
| 4,020,615 A * | 5/1977 | Irvine | ..... | B43M 3/045 271/2 |
| 4,205,506 A * | 6/1980 | Moens | ..... | B43M 3/045 53/284.3 |
| 4,765,502 A * | 8/1988 | Pintsov | ..... | B07C 1/00 198/349 |

(Continued)

FOREIGN PATENT DOCUMENTS

| | | | | |
|---|---|---|---|---|
| EP | 0 943 458 A1 | 9/1999 | | |
| EP | 2149459 A2 * | 2/2010 | ..... | B43M 3/045 |

(Continued)

*Primary Examiner* — Andrew M Tecco
*Assistant Examiner* — Mary Hibbert
(74) *Attorney, Agent, or Firm* — Collard & Roe, P.C.

(57) ABSTRACT

A method for opening an envelope throat of an envelope transported along an envelope channel dependably opens the envelope throat of the envelope during insertion in an inserter. The envelope, in order to open the envelope throat, is first over-pressed against a counter-pressure and then the counter-pressure is released to open the envelope throat, and/or the envelope is over-pressed against the hold-down force that holds the envelope down on an envelope transport, in order to open the envelope throat. For this purpose, an inserter inserts one or more items into an envelope moving along an envelope channel.

29 Claims, 5 Drawing Sheets

(56) References Cited

U.S. PATENT DOCUMENTS

| | | | | |
|---|---|---|---|---|
| 4,817,369 | A * | 4/1989 | Tribbey | B65B 25/002 53/284.3 |
| 4,944,137 | A * | 7/1990 | Krasuski | B43M 3/045 53/284.3 |
| 7,717,418 | B2 | 5/2010 | Kern et al. | |
| 7,788,880 | B2 | 9/2010 | Kern | |
| 2006/0042196 | A1 | 3/2006 | Stemmle et al. | |
| 2010/0059920 | A1* | 3/2010 | Kern | B65H 1/025 271/2 |

FOREIGN PATENT DOCUMENTS

| | | | |
|---|---|---|---|
| WO | 2004/098905 | A1 | 11/2004 |
| WO | 2011/138447 | A1 | 11/2011 |

* cited by examiner

INSERTER AND METHOD FOR OPENING AN ENVELOPE THROAT OF AN ENVELOPE TRANSPORTED ALONG AN ENVELOPE CHANNEL

CROSS REFERENCE TO RELATED APPLICATIONS

Applicant claims priority under 35 U.S.C. § 119(e) of U.S. Provisional Patent Application Ser. No. 61/740,148 filed Dec. 20, 2012, the disclosure of which is incorporated by reference.

BACKGROUND OF THE INVENTION

1. Field of the Invention

The invention relates to an inserter and to a method for opening an envelope throat of an envelope transported along an envelope channel.

2. Description of the Related Art

An inserter of the stated type and an opening method of the stated type are disclosed, for example, in WO 2011/138447 A1. On the other hand, it is known from EP 0 943 458 A1, with a resting envelope, in a connection not in accordance with the type, to apply opposed forces to an envelope in order to open the envelope throat. In this method, however, a corresponding under-presser and a corresponding over-presser are disposed in a fixed location with reference to the envelope. In the case of the inserter known from WO 2004/098905 A1, the envelope throat is opened by means of a blowing unit. U.S. Pat. No. 7,717,418 B2 discloses an inserter in which the envelope throat is opened by means of an opening element that can rotate about an axis, by means of rotation of same about this axis.

SUMMARY OF THF INVENTION

It is the task of the present invention to make available an inserter of the stated type and a method of the stated type, for opening an envelope throat of an envelope transported along an envelope channel, in which the envelope throat can be reliably opened in structurally simple manner.

As a solution, inserters and opening methods, respectively, according to the invention are proposed, whereby these inserters and opening methods proceed from the general basic idea of the invention, of twisting the envelope in itself during its transport, in order to open it in operationally reliable manner. Further advantageous solutions are set forth in the description below.

A method for opening an envelope throat of an envelope transported along an envelope channel, while the envelope is being transported, in one aspect operates so that the envelope, in order to open the envelope throat, is first over-pressed against a counter-pressure and then the counter-pressure is released to open the envelope throat (step i); and/or that the envelope is over-pressed against the hold-down force that holds the envelope down on an envelope transport, in order to open the envelope throat (step ii). Each of the steps i and ii provided allows dependable opening of the envelope throat, in structurally simple manner. Not only step i but also step ii can be provided alone, in other words without providing the other step, in each instance.

Thus, the method for opening an envelope throat of an envelope transported along an envelope channel, while the envelope is being transported, may operate so that the envelope is first over-pressed against a counter-pressure, to open the envelope throat, and then the counter-pressure is released in order to open the envelope throat.

As a result of the over-pressing provided first and the release of the counter-pressure that follows it, the envelope can spring open, thereby making it possible to implement dependable opening of the envelope. In particular, dependable opening of the envelope throat can be implemented in structurally simple manner, because over-pressing against a counter-pressure and release of the counter-pressure can be implemented in technically simple manner. For example, the counter-pressure can be technically implemented by means of a contact surface that is fixed in place and provided for building up the counter-pressure. For over-pressing, an element fixed in place—in other words an element that stands still relative to the moving or transported envelope—can be provided, which guides the moving envelope in the direction of the counter-pressure or in the direction of the contact surface for building up the counter-pressure.

By the over-pressing that is provided, a stress builds up in the envelope, and stress energy is introduced into the envelope as a result of the over-pressing. As a result, when the counter-pressure is released, the stress is discharged by the envelope springing open, and the stress energy that was introduced is transformed into a kinetic energy of the envelope springing open when the counter-pressure is released.

A method for opening an envelope throat of an envelope transported along an envelope channel, while the envelope is being transported, can also be characterized in that the envelope is over-pressed against a hold-down force that holds the envelope down on an envelope transport, in order to open the envelope throat.

By means of over-pressing the envelope against the hold-down force that holds the envelope down on the envelope transport, the envelope can be forced open in simple and practical manner, accompanied by dependable opening of the envelope throat. Over-pressing against the hold-down force that holds the envelope down can be implemented in structurally simple manner, for example in that by providing a guide element having a guide surface, which element is fixed in place, a partial region of the moving envelope is guided away from the envelope transport, moving away by means of sliding on the guide surface, and/or is placed at a distance from the envelope transport. The partial region of the envelope can particularly be an oblong partial region of the envelope that is oriented parallel to the transport direction, for example, or that is oriented parallel to one of the four straight-line edges of the generally rectangular envelope, for example.

Over-pressing is understood to be deformation of the envelope as the result of a pressure effect or force effect and the accompanying buildup of a counter-pressure, a counter-force, or a correspondingly acting hold-down force. In this connection, the deformation has a cross-sectional shape of a cross-section of the envelope that deviates from an unstressed situation, which runs perpendicular or parallel to the longitudinal expanse of the envelope or perpendicular or parallel to the transport direction provided for the envelope or in an envelope plane, whereby the envelope lies on a flat surface, for example, in an unstressed situation, thereby defining the envelope plane.

For example, the envelope can have a cross-sectional shape with bent regions in the case of a deformation brought about by over-pressing, which regions are configured in a straight line or essentially in a straight line in the unstressed situation. This deformation can therefore also be present in every direction in the envelope plane.

It is certainly advantageous, in terms of design and also in terms of the method sequence, to configure the deformation parallel to the transport direction or parallel to a longitudinal expanse direction of the envelope, or perpendicular to it, and to do without slanted deformations. Standard deformations are not entirely precluded, however, because in this way, suitable springing open, particularly in the case of special envelope types, might be made possible in the first place.

The hold-down force that holds the envelope down on the envelope transport is preferably a force that acts exclusively on that cover of the envelope that faces the envelope transport or that has the least distance from the latter.

The force to be expended for over-pressing is opposed to the hold-down force or has force components that are opposed to the hold-down force.

Of course, the above steps i and ii can also be combined in a single method that is characterized in that the envelope is first pressed against a counter-pressure, in order to open the envelope throat, and then the counter-pressure is released to open the envelope throat (step i), and that the envelope is additionally over-pressed against a hold-down force that holds the envelope down on an envelope transport, to open the envelope throat (step ii). By means of the combination of the two steps, whereby step i brings about opening of the envelope throat by means of the envelope springing open, and step ii brings about opening of the envelope throat by means of forcing the envelope open, very dependable opening of the envelope throat can be implemented in structurally simple manner, in such a manner that the two effects, acting synergistically, can implement very dependable opening of the envelope throat.

Where an envelope has an upper cover and a lower cover longer than the upper cover, the counter-pressure of the upper cover can be released to open the envelope throat. Because the lower cover is configured to be longer than the upper cover, a counter-pressure that continues to act on the lower cover after the counter-pressure on the upper cover has been released can advantageously continue to hold the envelope open after the envelope throat has been opened.

Preferably, counter-pressing takes place by means of under-pressing. Under-pressing differs from the over-pressing described above in that the force that brings about deformation of the envelope is oriented opposite to the over-pressing force or not opposite to the hold-down force but rather counter to the over-pressing force or in the direction of the hold-down force or has force components in the direction of the hold-down force. As a result of under-pressing, the spring-open effect of the envelope described above can be very effectively reinforced by release of under-pressing, accompanied by very operationally reliable springing open of the envelope.

Preferably, over-pressing and/or counter-pressing could take place by a relative movement parallel to a main surface of the envelope. The opening method can be incorporated into an inserting method or an inserting process of an inserter, in which one or more items are inserted or introduced into envelopes that move along the envelope channel, in simple and practical manner, by the provided movement of over-pressing and/or counter-pressing relative to the envelope, specifically parallel to a main surface of the envelope.

A method for opening an envelope throat of an envelope transported along an envelope channel, while the envelope is being transported along an envelope channel, can also operate so that the envelope is moved past a counter-guide that is displaced in the same direction as the envelope channel with reference to the envelope, and past an over-presser that is displaced in the same direction as the envelope channel with reference to the envelope (step i) and/or is moved past an over-presser that is displaced in the same direction as the envelope channel with reference to the envelope, acting counter to a hold-down force that holds the envelope down on an envelope transport (step ii).

It is understood that the two steps i and ii can be carried out separately from one another, so that a method for opening an envelope throat of an envelope transported along an envelope channel, while the envelope is being transported along an envelope channel, can be particularly characterized in that the envelope is moved past a counter-guide that is displaced in the same direction as the envelope channel with reference to the envelope and past an over-presser that is displaced in the same direction as the envelope channel with reference to the envelope.

A mechanical stress can be built up in the envelope by means of being moved past the counter-guide and the over-presser, or the envelope can be provided with mechanical stress energy by means of being moved past them, which energy can be converted, during the further course of the movement of the envelope, into a movement energy of the envelope that springs open, for example in that during the further course of the movement of the envelope, no counter-guide is provided. The envelope throat can be reliably opened by reducing the built-up or introduced mechanical stress or by conversion of the stress energy that was introduced into kinetic energy of the envelope springing open. Dependable opening of the envelope throat can be implemented in structurally simple manner, because only a counter-guide that can be implemented in structurally simple manner and an over-presser that can be implemented in structurally simple manner need to be made available for this purpose.

For introduction of the mechanical stress energy, the counter-guide and the over-presser can comprise a convex curvature, in each instance, with reference to the envelope, in each instance, in the movement direction of the envelope, in each instance. The convex curvature of the counter-guide and of the over-presser is preferably configured to be the same or essentially the same.

Furthermore, the method—specifically if step ii is exclusively provided—for opening an envelope throat of an envelope transported along an envelope channel, while the envelope is being transported along an envelope channel, can be characterized in that the envelope is moved past an over-presser that is displaced in the same direction as the envelope channel with reference to the envelope, acting counter to a hold-down force that acts on the envelope, holding it down on an envelope transport.

The envelope can advantageously be forced open by the over-presser provided, which acts counter to a hold-down force that holds the envelope down on the envelope transport, accompanied by dependable opening of the envelope. The over-presser that brings about this advantageous forcing open of the envelope can particularly be configured in the form of the over-presser provided in step i, which is displaced or extends in the same direction as the envelope channel with reference to the envelope. The over-presser particularly can have the convex curvature that is present with reference to the envelope, in each instance, as already described above, in the movement direction of the envelope, in each instance.

In particular, the two steps i and ii can also be combined. In this case, a method for opening an envelope throat of an envelope transported along an envelope channel, while the envelope is being transported along an envelope channel, operates so that the envelope is moved past a counter-guide that is displaced in the same direction as the envelope channel with reference to the envelope, and past an over-presser that is displaced in the same direction as the envelope channel with reference to the envelope, and past an over-presser that is displaced in the same direction as the envelope channel with reference to the envelope and acts against a hold-down force that holds the envelope down on an envelope transport. By moving the envelope past the counter-guide and the over-presser according to step i and past the over-presser against a hold-down force according to step ii, as provided, the advantageous effects connected with the two steps, in other words for one thing, the envelope springing open, and for another the envelope being forced open, can advantageously act together, accompanied by very dependable opening of the envelope throat.

Preferably, the over-presser and/or the counter-guide can stand still with reference to the envelope channel. In this manner, very operationally reliable opening of the envelope throat is possible, whereby particularly preferably, the over-presser and the counter-guide stand still relative to one another.

Particularly preferably, the envelope moves past the counter-guide first, thereby advantageously making it possible to implement very operationally reliable opening of the envelope throat in that buildup of the mechanical stress described above or introduction of the stress energy takes place only after previous guidance along the counter-guide, so that buildup of the mechanical stress or introduction of the stress energy can advantageously take place in an operationally reliably guided state of the envelope.

Particularly preferably, the counter-guide is an under-presser. The effect of the counter-guide can clearly be reinforced by means of the under-presser provided, in that the counter-guide is reinforced by under-pressing, in other words deformation of the envelope with a force that acts in the direction of the hold-down force of the down-holder, in each instance, or by force components in the direction of the hold-down force.

Preferably, the envelope is held open by at least one filling aid that engages into the envelope and moves along with the envelope, preferably synchronously. The opening method can be incorporated into an inserter or into an inserting apparatus, in which one or more items are inserted or introduced into the envelope that moves along the envelope channel, particularly well and in operationally reliable manner by holding the envelope open with the filling aid that engages into the envelope and moves along with the envelope, preferably synchronously, as provided. In this connection, the filling aid advantageously allows reliably maintaining the opened state of the envelope throat that has been opened using the method, in order to introduce the item or items into the envelope or to insert the item or items into the moving envelope or into the moving envelopes in operationally reliable manner. Very process-reliable incorporation into an inserter or into an insertion process can be made available by means of the filling aid moving along with the envelope, preferably synchronously.

The filling aid can engage into the over-pressed envelope in order to implement dependable opening of the envelope, whereby the filling aid preferably engages into the over-pressed envelope without touching an envelope cover that faces away from the filling aid, accompanied by a significant increase in the operational reliability when the filling aid engages into the envelope.

An over-pressed envelope is understood to mean—see also the above explanations—an envelope that has been deformed by means of corresponding pressure or force effect. For engagement of the filling aid, the envelope is or has been deformed by the over-pressing, specifically in such a manner that the envelope throat has been opened. In this connection, the force to be expended for over-pressing is preferably opposed to the hold-down force or has force components that are opposed to the hold-down force.

An inserter for inserting one or more items into an envelope moving along an envelope channel, whereby the inserter has means for opening a moving envelope and keeping it open, can have the opening means comprise at least one over-presser that is fixed in place and a counter-guide that is fixed in place and acts counter to the over-presser, preferably as an under-presser that is fixed in place, and/or a down-holder that runs along with the envelope transport.

As is also evident from the above explanations, dependable opening of the envelope throat can be implemented in structurally simple manner via an opening means that comprises at least one over-presser that is fixed in place and a counter-guide that is fixed in place and acts counter to the over-presser.

In general, any desired apparatus that is set up for pressing the moving envelope against the counter-guide can be used as an over-presser, accompanied by over-pressing of the envelope, which operates so that the envelope deforms, whereby the deformation has a cross-sectional shape of a cross-section of the envelope that deviates from an unstressed situation of the envelope, which runs perpendicular or parallel to the longitudinal expanse of the envelope or parallel or perpendicular to the transport direction provided for the envelope.

In general, any desired apparatus that is set up for implementing deformation of the envelope by means of the effect of a force or the effect of force components can also be used for the under-presser, whereby this force or these force components is/are oriented opposite the force required for over-pressing, in contrast to this force.

In particular, the over-presser can project into the envelope channel and comprise a guide surface, whereby a partial region of the moving envelope is guided away at a distance from the envelope transport, by sliding on the guide surface, and/or spaced apart from the envelope transport. In particular, guiding away or spacing apart can advantageously be implemented or brought about by a guide surface that runs in wedge shape, in cross-section, for example. Particularly advantageously, a movement component that is directed toward the counter-guide can be imposed on the envelope as it slides over the guide surface, by way of this guide surface, in order to thereby ultimately implement the over-pressing of the envelope. The partial region of the envelope can particularly be an oblong partial region of the envelope, which is oriented parallel to the transport direction, for example, or that is oriented parallel to one of the four straight-line edges of the generally rectangular envelope, for example.

The counter-guide—which is preferably configured as an under-presser that is fixed in place or preferably comprises an under-presser that is fixed in place—can also have a guide surface that projects into the envelope channel. Preferably configuring the counter-guide as an under-presser that is fixed in place or as including such an under-presser that is fixed in place brings with it the advantage that the effect of the counter-pressure is reinforced by the under-pressing of the envelope that is possible with the under-presser, accompanied by very effective or operationally reliable springing opening of the envelope, for operationally reliable or dependable opening of the envelope throat.

The dependable opening of the envelope throat that is possible by means of the over-presser that is fixed in place and the counter-guide that acts counter to it, which is particularly possible in structurally simple manner, can particularly be implemented without providing the down-holder that runs along with the envelope transport. Specifically, the mechanical stress already explained above or the stress energy can be made available in the envelope by the over-presser that is fixed in place and by the counter-guide that acts counter to it. The mechanical stress or the stress energy can be converted to kinetic energy of the envelope springing open, as the result of the subsequent absence of the counter-guide.

It is also possible, however, to do without the counter-guide or the under-presser that is fixed in place, in the inserter, so that dependable opening of the envelope throat that can be implemented in structurally simple manner can be implemented merely by providing the over-presser and the down-holder that runs along with the envelope transport. Specifically, it is possible to have the envelope over-pressed by the over-presser, to open the envelope throat, by forcing it open counter to a hold-down force that holds the envelope down on the envelope transport, which force is made available by the down-holder to hold the envelope down on the envelope transport.

Of course, the advantageous effects described above—springing open of the envelope and forcing the envelope open—can also be advantageously combined, in synergistically acting manner, specifically in such a manner that the over-presser that is fixed in place, the counter-guide that acts counter to it, and also the down-holder that runs along with the envelope transport are provided.

The advantageous effects described above—in other words springing open of the envelope and forcing the envelope open—can ultimately, in the case of a corresponding configuration, be a result of the circumstance that the over-presser and/or the counter-guide or the under-presser distort the selected cross-section of the envelope channel perpendicular to the movement path of the envelope through the envelope channel.

Preferably, the over-presser is disposed behind the counter-guide or behind the under-presser in the movement direction of the envelope, in each instance, so that the envelope therefore moves past the counter-guide first. This arrangement has the advantage, as also already explained above, that buildup of a mechanical stress or introduction of the stress energy takes place only after previous guidance along the counter-guide. In this way, buildup of the mechanical stress or introduction of the stress energy can advantageously take place in an operationally reliably guided state of the envelope.

In a preferred embodiment, the over-presser projects beyond the path of the down-holder and preferably beyond a held-down envelope cover of the envelope, in each instance, in the direction of a further envelope cover of the envelope, in each instance. By means of the projection of the over-presser beyond the path of the down-holder, preferably beyond the held-down envelope cover of the envelope, in each instance, in the direction of a or the further envelope cover, very marked over-pressing of the envelope can advantageously be implemented, accompanied by very dependable opening of the envelope throat.

Preferably, at least one of the opening means, in other words the over-presser, under-presser, counter-guide, and down-holder, is configured not to extend over the entire width of the envelope channel. It should be emphasized at this point that the length of the envelope channel is defined parallel to the pass-through direction of the envelope through the inserter, the width of the envelope channel is defined perpendicular to this and parallel to the expanse of the envelope, and the height of the envelope channel is defined perpendicular to the width and to the length of the envelope channel. The cross-section of the envelope channel is defined as the cross-section spanned by the width and the height.

An inserter for inserting one or more items into an envelope that moves along an envelope channel, whereby the inserter comprises means for opening a moving envelope and holding it open, can also be designed so that the opening means comprise distortion of the cross-section of the envelope channel, selected perpendicular to the movement path of the envelope through the envelope channel.

Dependable opening of the envelope throat can be implemented by the distortion of this cross-section as provided, in practical and simple manner, particularly in structurally simple manner, whereby dependable opening of the envelope throat can particularly be implemented in that the cross-section is partly raised and partly lowered for the distortion.

A further inserter for inserting one or more items into an envelope that moves along an envelope channel, whereby the inserter comprises means for opening a moving envelope and holding it open, can also be designed so that the opening means comprise a convex curvature of the envelope channel in the movement direction of the envelope, in each instance, with reference to the envelope, in each instance.

A mechanical stress can be introduced into or a mechanical stress can be built up in the envelope, by the convex curvature of the envelope channel in the movement direction of the envelope, in each instance, by moving it in the envelope channel, with which stress dependable opening of the envelope throat is possible after it has passed through the convex curvature, due to the envelope springing open. In particular, the convex curvature of the envelope channel can advantageously be implemented technically in structurally simple manner.

Preferably, the opening means comprise a counter-guide disposed on the outside of the convex curvature, which opens, preferably ends, just ahead of an opening region in the direction away from the envelope channel. The envelope is first provided with the mechanical stress or stress energy required for the envelope to spring open, by the convex curvature provided. Thereafter, the envelope can advantageously spring open just ahead of the opening region or when it reaches the opening region, as a result of the end of the counter-guide in the opening region or by opening of the counter-guide just ahead of the opening region, for dependable opening of the envelope throat. The opening region of the inserter is a region in which opening of the envelope or opening of the envelope throat of the envelope is provided.

In a preferred embodiment, the inserter comprises an envelope guide that moves filling aids along with the envelope transported by the envelope transport, and an item transport for supplying the item or items to the envelopes, and whereby the opening means are disposed in a pivot-in region in which the filling aid pivots into the envelope, in each instance.

All the devices provided in this preferred embodiment—in other words the envelope guide that moves filling aids along with the envelope transported by the envelope transport, the item transport for supply of the item or items to the envelopes, and the opening means in the pivot-in region in which the filling aid pivots into the envelope, in each instance—advantageously allow operationally reliable insertion of the item or items into the envelope, in their interaction.

In practice, it has proven itself if the envelope is opened opposite to the transport direction with reference to its transport direction through the inserter. In other words the envelope throat is disposed opposite the transport direction when it is opened. In this way, the effects of springing open that are brought about by the over-pressing and the counter-pressure or the hold-down force can be achieved in particularly advantageous manner, although one would at first be inclined to expect similar advantages in this regard if the movements were reversed. In practice, however, it has been shown that corresponding opening of the envelope throat can be implemented particularly effectively if it is disposed opposite the transport direction during over-pressing.

Preferably, the envelope is then also filled from behind, so that no reversal of the movement direction or new orientation of the envelope with reference to the movement direction needs to occur.

It is also advantageous, for an envelope having an upper cover and a lower cover longer than the upper cover, to have the over-presser act on the envelope at the lower cover or to over-press the envelope from the direction of the lower cover. In this way, the counter-guide or the under-presser acts on the envelope from the direction of the upper cover or the hold-down force acts on the envelope facing in a direction from the upper cover to the lower cover. This feature supports operationally reliable springing open of the envelope. In particular, it is advantageous if gravitation is additionally utilized, in that the longer lower cover is disposed at the bottom during opening, so that gravitation is directed parallel to at least one component of the hold-down force or in the same direction as a direction of effect of the counter-guide, and at least one component is directed opposite the direction of effect of the under-presser, in the region in which the envelope is to be opened.

Preferably, the envelope transport comprises a suction belt that serves as a down-holder. Very dependable transport of the envelope can be implemented with a suction belt that serves as a down-holder, in simple and practical manner.

It is understood that the characteristics of the solutions described above and in the claims can also be combined, if necessary, in order to be able to implement the advantages in correspondingly cumulative manner.

For example, the opening means can comprise an air nozzle that opens the envelope throat, at least in supporting manner. Preferably, the air nozzle can be provided in the over-presser, in the counter-guide or in the under-presser, or also in the down-holder that moves along with the envelope or acting through the down-holder that moves along with the envelope, because these modules come into very close contact with the envelope, in each instance, in any case, and this proximity applies particularly in the regions in which the envelope, in each instance, is to be opened. Depending on the concrete implementation, a constant air stream or a pulsating air stream can be passed through the air nozzle.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
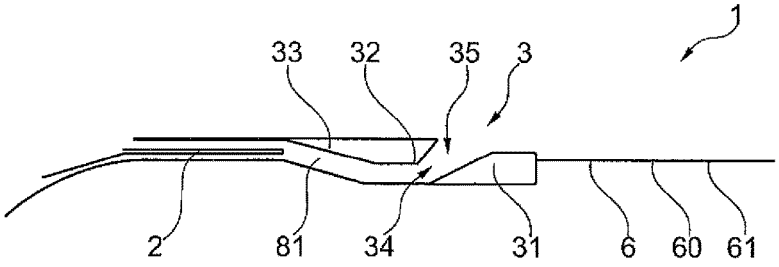
FIG. 1 is a sectional schematic side view of the opening region of an inserter with an envelope running toward under-pressers.
Figure 2:
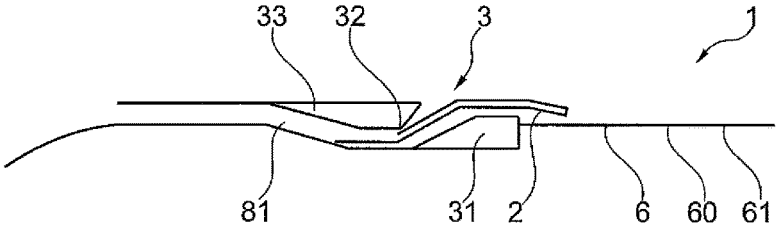
FIG. 2 shows the arrangement according to FIG. 1, when the envelope has almost moved past each under-presser and has reached the over-pressers, before the upper cover of the envelope has moved past each under-presser, whereby in the region of each over-presser, a convex curvature of the envelope channel is present and over-presser and under-presser do not extend over the same width (perpendicular to the plane of the drawing) of the envelope channel, so that there, the envelope channel is distorted in cross-section.

Turning now in detail to the drawings, the inserter 1 according to FIG. 1, for inserting one or more items into an envelope 2 that moves along an envelope channel 81, comprises opening means 3 for opening a moving envelope 2 and means for holding the moving envelope 2 open. The means for holding the moving envelope 2 open are not shown schematically in all the sectional representations—and also not in FIG. 1—for the sake of simplification. Nevertheless, a means for holding the envelope open is provided in all the inserters 1 according to FIGS. 1 to 16, in each instance, in the form of a filling aid 7 according to FIG. 5.

The opening means 3 comprise two over-pressers 31 that are fixed in place, of which only one is shown in the sectional representation according to FIGS. 1 to 12. The two over-pressers 31 are disposed following one another in the width direction of the envelope channel 81.

Furthermore, the opening means 3 comprise two counter-guides 32 configured as under-pressers 33 that are fixed in place, whereby one counter-guide 32, in each instance, acts or can act against one over-presser 31, in each instance. For one of the over-pressers 31 that are fixed in place, in each instance, one under-presser 33 is therefore provided, in each instance, which serves as a counter-guide 32 that is fixed in place and acts opposite to the over-presser 31, in each instance.

As is evident, the over-pressers 31 and the counter-guides 32 or under-pressers 33 do not extend over the entire width of the envelope channel 81, which is thereby distorted by the over-pressers 31 and the counter-guides 32 or under-pressers 33.

The two over-pressers 31 and the two under-pressers 33 form a distortion 34 (see FIG. 1) of the cross-section of the envelope channel 81 selected perpendicular to the movement path of the envelope 2 through the envelope channel 81.

In the sectional representations according to FIGS. 1 to 12, only one of the two under-pressers 33 is shown schematically, in each instance. The two under-pressers 31 are also disposed to follow one another in the width direction of the envelope channel 81.

Furthermore, the inserter 1 comprises an envelope transport 6 having a suction belt 61 that serves as a down-holder 60.

Figure 3:
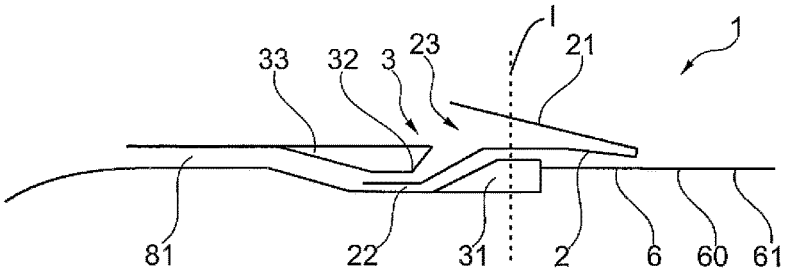
FIG. 3 shows the arrangement according to FIGS. 1 and 2, when the upper cover has moved past every under-presser and the envelope throat has just sprung open.
Figure 4:
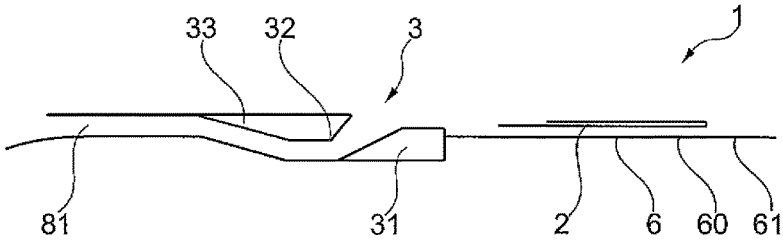
FIG. 4 shows the arrangement according to FIGS. 1 to 3, when the envelope lies on the suction belt as the envelope transport once again, relaxed.

The envelope 2 or each envelope 2 has an upper cover 21 and a lower cover 22. The lower cover 22 is configured to be longer than the upper cover 21 as shown in FIG. 3.

Each over-presser 31 (see, in this regard, particularly also FIG. 12) projects beyond the path of the down-holder 60 and beyond the lower cover 22 of the envelope 2, in each instance, which cover is held down, in the direction of the upper cover 21 of the envelope, in each instance.

Over-pressing is understood to be a deformation of the envelope 2 as a result of a pressure or force effect and the accompanying buildup of the counter-pressure. The deformation is characterized, in this connection, by a cross-sectional shape of the envelope 2 that deviates from an unstressed situation, which cross-section runs perpendicular or parallel to the longitudinal expanse of the envelope 2 or in an envelope plane that is formed by the correspondingly unstressed envelope 2, and not only parallel (see, for example, FIG. 2) to the transport direction provided for the envelope 2, but also perpendicular (see FIG. 12) to the transport direction.

As is directly evident, the envelope 2 is transported in a transport direction, in such a manner that its envelope throat lies at the back or that the envelope 2 opens toward the back and is closed toward the front. In this way, a particularly advantageous springing-open effect is achieved.

In this connection, the lower cover of the envelope 2 is configured to be longer than the upper cover, and comprises a tab, in known manner. The over-presser 31 acts on the envelope 2 from the direction of the lower cover, while the counter-guide 32 or the under-presser 33 but also the down-holder 60 act on the envelope 2 with a direction of effect that faces from the upper cover to the lower cover. This arrangement also supports springing open of the envelope 2.

For support, the lower cover faces downward during opening. In this way, gravitation impacts the lower cover with a force supplemental to the down-holder 60 and the counter-guide 32 or the under-presser 33, counter to the direction of effect of the over-presser 31.

Figure 5:
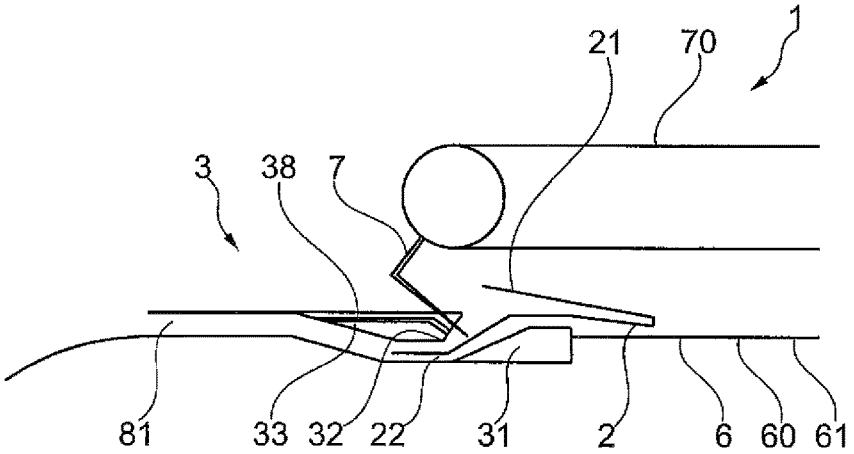
FIG. 5 is a sectional schematic side view of the opening region of a further inserter, in which an air nozzle that supports opening of the envelope is provided in each under-presser, whereby an envelope is in the position corresponding to FIG. 3.
Figure 6:
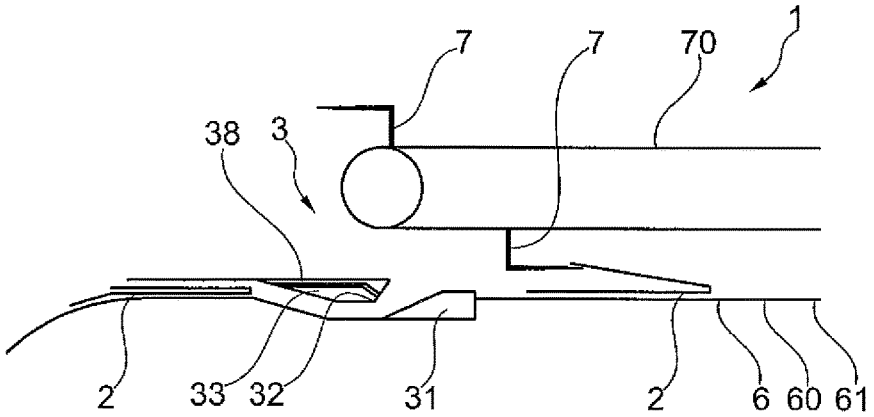
FIG. 6 shows the arrangement according to FIG. 5, whereby a filling aid has engaged into the envelope according to FIG. 5, which holds the envelope open while a further envelope is fed in through the envelope channel.

The inserter 1 according to FIGS. 5 and 6 differs from the inserter 1 according to FIGS. 1 to 4 in that in this inverter, an air nozzle 38 that supports opening of the envelope 2 is disposed in each under-presser 33.

Figure 7:
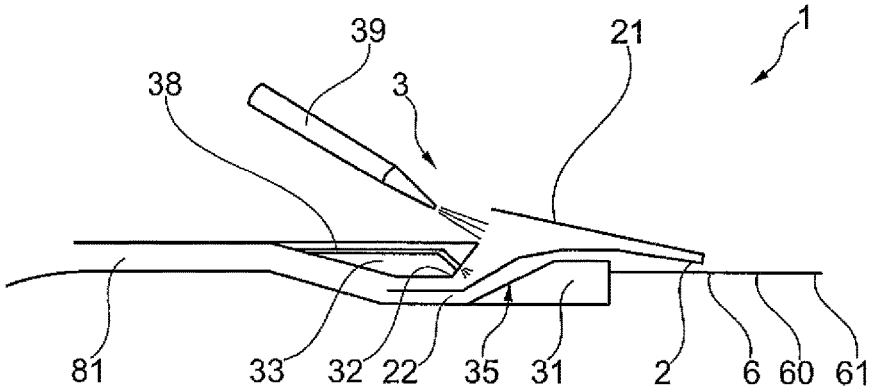
FIG. 7 is a sectional schematic side view of the opening region of a further inserter, in which an air nozzle that supports opening of the envelope and a further air nozzle that serves this purpose are provided in each under-presser, whereby an envelope is in the position corresponding to FIGS. 3 and 5.

The inserter 1 according to FIG. 7 differs from the one according to FIGS. 5 and 6 in that here, a further air nozzle 39 is provided, which supports opening of the envelope 2.

In a method for opening an envelope throat 23 of an envelope 2 transported along the envelope channel 81, using the inserter 1 according to FIGS. 1 to 4, opening of the envelope throat 23 takes place while the envelope 2 is being transported via the envelope transport 6.

In the method, the envelope 2 is first over-pressed to open the envelope throat 23 according to a step i, counter to a counter-pressure (see FIG. 2), and then the counter-pressure is released to open the envelope throat 23, thereby causing the envelope 2 to spring open (see, in this regard, FIG. 3). Opening of the envelope when using the inserter 1 according to FIGS. 5 and 7 is advantageously supported by blowing air into the envelope 2 while it is being opened, by way of the air nozzle 38 and/or the air nozzle 39 (see FIGS. 5 to 7).

Counter-pressing takes place by means of the under-presser 33, by means of under-pressing, whereby each of the two under-pressers 33 under-presses an oblong partial region or strip region of the envelope 2 while it moves by means of the envelope transport 6, which region extends parallel to the transport direction or parallel to an edge of the envelope 2.

Release of the counter-pressure—which is built up in that the envelope 2 is pressed against the under-presser 33 or against the counter-guide 32 by the over-presser 31—takes place in that in the further course of the movement of the envelope 2, making available or building up the counter-pressure via pressing the upper cover 21 against the counter-guide 32 or the under-presser 33 via the over-presser 31 is eliminated, specifically by limiting the expanse of the counter-guide 32 or of the under-presser 33 in the direction of movement of the envelope 2.

Furthermore, opening of the envelope throat 23 by means of forcing the envelope 2 open is provided to act synergistically with opening of the envelope throat 23 by means of the envelope 2 springing open, as described above. Forcing the envelope 2 open is done in that according to a step ii, the envelope 2 is over-pressed counter to a hold-down force that holds the envelope 2 down on the envelope transport 6, by means of each of the two over-pressers 31.

Viewed from the reference system of the envelope 2, over-pressing and counter-pressing take place via a relative movement parallel to a main surface of the envelope 2.

In addition to the above steps i and ii for opening the envelope throat, each envelope 2 is held open by means of a filling aid 7 that moves along synchronously with the envelope 2 and engages into the envelope 2 (see, in particular, FIG. 6). The filling aid 7 (see FIG. 6) engages into the over-pressed envelope 2 for this purpose, in such a manner that it does not touch the lower cover 22 that faces away from the filling aid 7.

Figure 8:
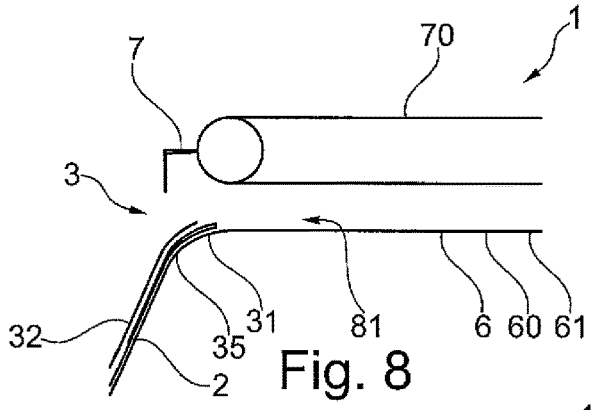
FIG. 8 is a sectional schematic side view of the opening region of a further inserter having a suction belt as the envelope transport and as a down-holder, and having a convex curvature as an opening means, and having a counter-guide that ends just ahead of an opening region or just ahead of a region in which the filling aid engages on the envelope, in each instance, with the envelope situated under the counter-guide.

In the inserter 1 according to FIG. 8, the opening means comprise a convex curvature 35 of the envelope channel 81 with reference to the envelope 2, in each instance, in the movement direction of the envelope 2, in each instance.

Furthermore, the opening means 3 comprise a counter-guide 32 disposed on the outside of the convex curvature 35, which guide ends in an opening region or which extends only up to this opening region. The opening region of the inserter 1 is a region in which opening of the envelope 2 or opening of the envelope throat 23 of the envelope 2 is provided for in the inserter 1.

In a method for opening an envelope throat 23 of an envelope 2 transported along an envelope channel 81, while the envelope 2 is being transported along the envelope channel 81, using the inserter 1 according to FIG. 8, the envelope 2 is moved past the counter-guide 32, which is displaced in the same direction as the envelope channel 81 with reference to the envelope 2, and past an over-presser 31 that is displaced in the same direction as the envelope channel 81 with reference to the envelope 2, The over-presser 31 is configured in the form of a curved partial section of the envelope channel 81.

Figure 9:
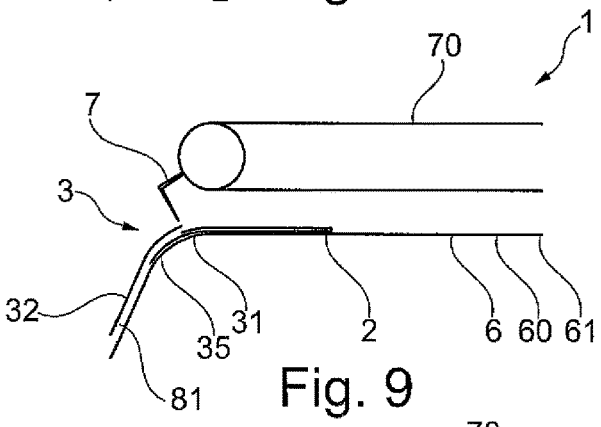
FIG. 9 shows the arrangement according to FIG. 8 just before the upper cover of the envelope leaves the counter-guide.
Figure 10:
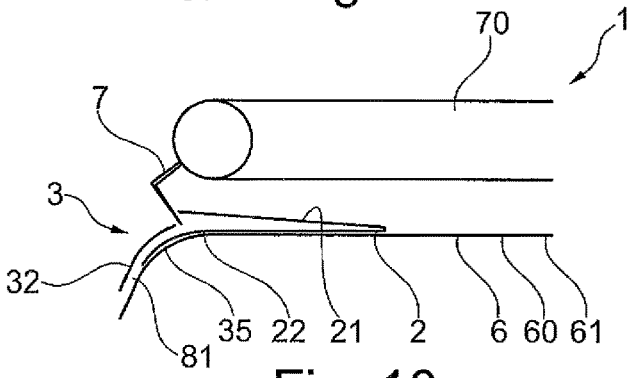
FIG. 10 shows the arrangement according to FIGS. 8 and 9, whereby the upper cover of the envelope has left the counter-guide and the envelope throat has sprung open, so that the filling aid can engage under the upper cover.
Figure 11:
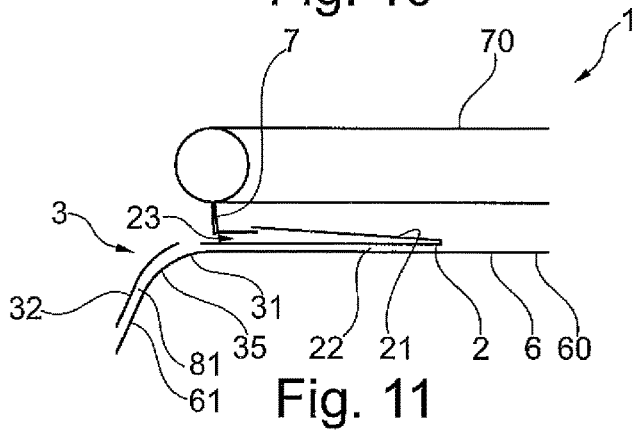
FIG. 11 shows the arrangement according to FIGS. 8 to 10, after the lower cover of the envelope has also left the counter-guide and the filling aid holds the envelope open.
Figure 12:
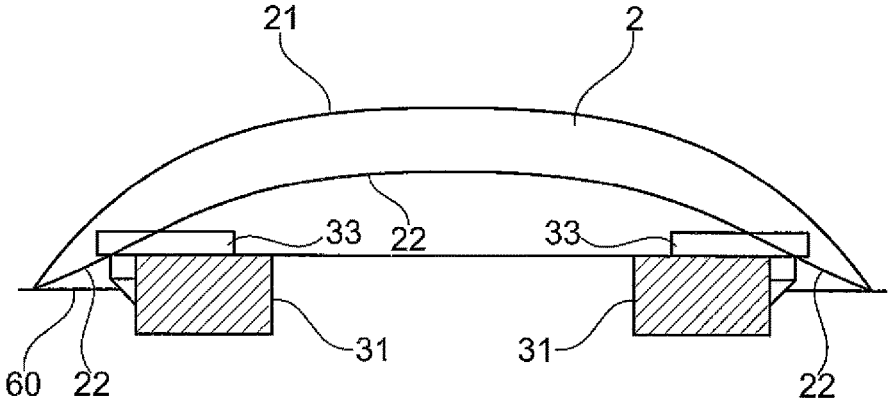
FIG. 12 is a schematic representation of the arrangement according to FIG. 3 along the section line I in FIG. 3.

Via the convex curvature 35 provided, a mechanical stress is built up or a stress energy is introduced in the envelope 2, in each instance, by means of its being moved past the counter-guide 32 and the over-presser 31, which stress or energy is discharged or converted to kinetic energy of the envelope 2 springing open when the upper cover 21 of the envelope 2 leaves the counter-guide 32 (see, in this regard, FIGS. 9 and 10).

After the lower cover 22 of the envelope 2 has also left the counter-guide 32, the envelope 2 is held open using the filling aid 7 (see FIG. 11), whereby the filling aid 7 engages under the upper cover 21 without touching the lower cover 22 after the envelope 2 has sprung open, to hold the envelope 2 open (see FIG. 10).

The inserter 1 according to FIGS. 13 to 16 also has the two over-pressers 31 that are fixed in place, as well as the two counter-guides 32 that are fixed in place and act against the over-presser 31, in the form of under-pressers 33 that are fixed in place. One under-presser 33, in each instance, is provided to act against one over-presser 31, in each instance. The over-pressers 31 and the under-pressers 33 are disposed to follow one another, in each instance, in the width direction of the envelope channel 81 (see, in this regard, particularly FIG. 13).

Figure 13:
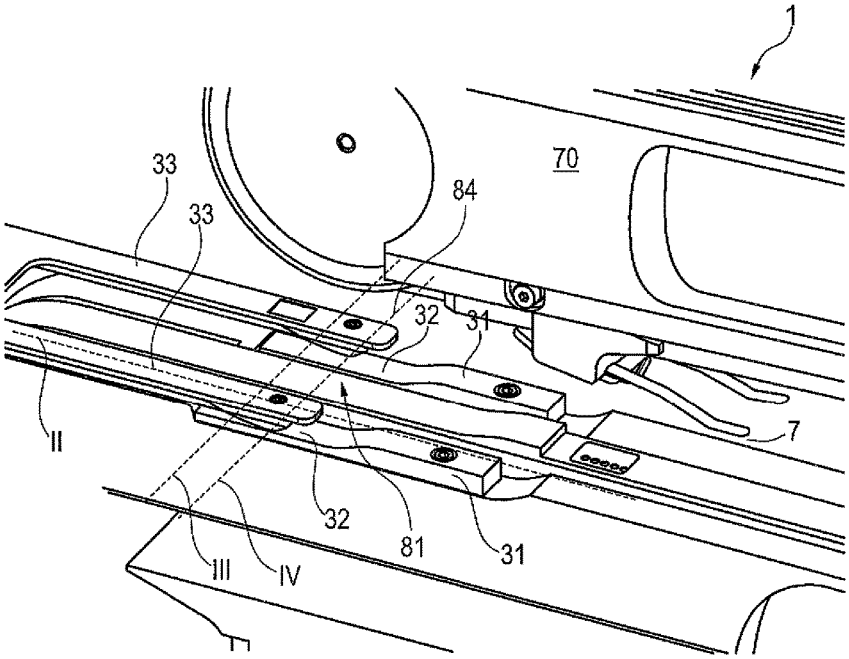
FIG. 13 is a three-dimensional representation of an opening region of an inserter that comprises an arrangement according to FIG. 5, without an envelope.
Figure 14:
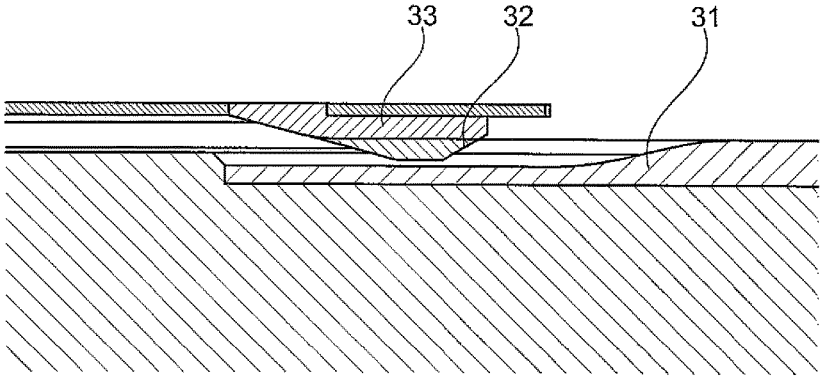
FIG. 14 is a schematic sectional representation of the opening region according to FIG. 13, along the section line II in FIG. 13.

The filling aid 7 is provided on the envelope guide 70 (see, in this regard, not only FIGS. 5 and 6 but especially also FIG. 13). The filling aid 7 (see FIG. 13) is configured in fork shape, in order to engage into the envelope, in each instance, in effective and operationally reliable manner (not illustrated in FIGS. 13 to 16). The under-pressers 33 and over-pressers 31, which are configured to be oblong (see also FIGS. 14 to 16), allow sufficient under-pressing or over-pressing of the envelope, in each instance, for dependable opening of the envelope throat, via over-pressing the envelope on strip-shaped partial surfaces of the envelope, in each instance, which surfaces extend in the transport direction of the envelope or in a direction parallel to the edge of the envelope, in each instance.

The envelope guide 70 (see FIG. 13) is set up to synchronously move the filling aid 7 along with the envelope transported by the envelope transport (not shown in any detail in FIG. 13).

An item transport provided above the under-pressers 33 and below the envelope guide 70 (not shown in any detail in FIG. 13) serves for feed of the item or items to the envelopes, in other words particularly for feed of sheets of paper to be inserted into the envelope.

The over-pressers 31 and the under-pressers 33 are disposed in a pivot-in region 84 in which the filling aid 7 pivots into the envelope, in each instance.

Figure 15:
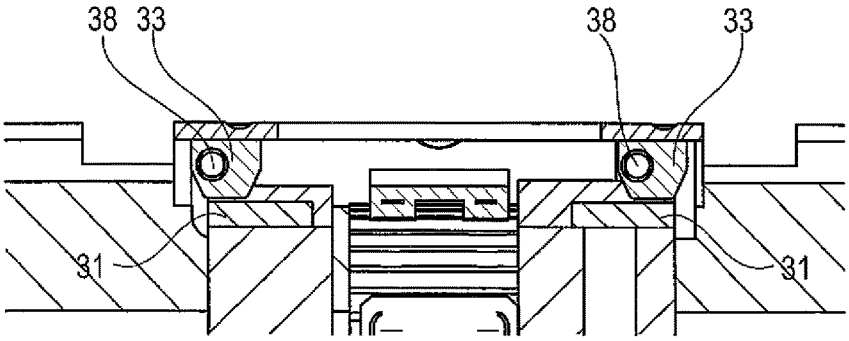
FIG. 15 is a schematic sectional representation of the opening region according to FIG. 13, along the section line III in FIG. 13.
Figure 16:
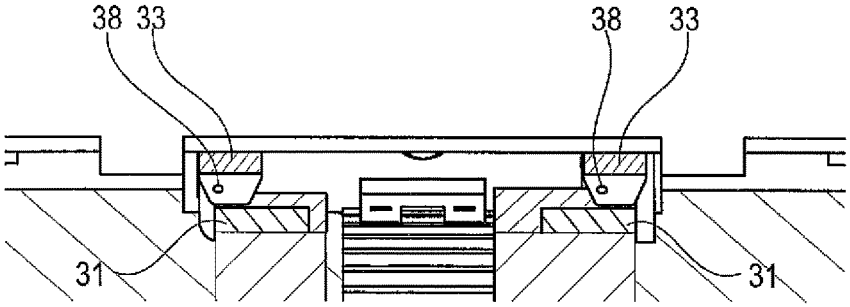
FIG. 16 is a schematic sectional representation of the opening region according to FIG. 13, along the section line IV in FIG. 13.

As can be seen in FIGS. 15 and 16, the under-presser 31 also has an air nozzle 38 that can be or is supplementally used to open the envelope 2, in each instance.

It is understood that—depending on the concrete application case, a constant air stream or a pulsating air stream, preferably cycled with the envelopes 2, can be guided to the envelopes 2 through the air nozzle 38. The same also holds true for the air nozzle 39.

Although only a few embodiments of the present invention have been shown and described, it is to be understood that many changes and modifications may be made thereunto without departing from the spirit and scope of the invention.

What is claimed is:

1. A method for inserting at least one item into an envelope while the envelope is being transported along an envelope channel, the method comprising:

(i) moving the envelope in the envelope channel past a counter-guide that is fixed in place and stands still with reference to the envelope channel;

(ii) subsequently moving the envelope in the envelope channel past an opener for opening the envelope while the envelope is moving, the opener comprising at least one over-presser that is fixed in place and that stands still with reference to the envelope channel, the counter-guide acting against the at least one over-presser such that an envelope throat of the envelope is opened, the at least one over-presser is disposed behind and spaced apart from the counter-guide in a movement direction of the envelope;

(iii) holding the envelope throat open via at least one holder, and (iv) inserting at least one item into the envelope via the envelope throat.

2. The method according to claim 1, wherein the envelope has an upper cover and a lower cover, wherein the lower cover is configured to be longer than the upper cover, and wherein the counter-pressure of the upper cover is released in order to open the envelope throat.

3. The method according to claim 1, wherein counter-pressing via the counter-guide takes place by under-pressing.

4. The method according to claim 1, wherein at least one of over-pressing via the over-presser and counter-pressing via the counter-guide takes place by a relative movement parallel to a main surface of the envelope.

5. The method according to claim 1, wherein the counter-guide is an under-presser.

6. The method according to claim 1, wherein the holder comprises at least one filling aid that moves along with the envelope and engages into the envelope.

7. The method according to claim 6, wherein the at least one filling aid moves along with the envelope synchronously.

8. An inserter for inserting at least one item into an envelope that moves along an envelope channel during insertion of the at least one item into the envelope, said inserter comprising an opener for opening a moving envelope and a holder for holding the moving envelope open, wherein the opener comprises at least one over-presser that is fixed in place and a counter-guide that is fixed in place and acts against the at least one over-presser, wherein the at least one over-presser and the counter-guide stand still with reference to the envelope channel, and wherein the at least one over-presser is disposed behind and spaced apart from the counter-guide in a movement direction of the envelope.

9. The inserter according to claim 8, wherein the counter-guide acts against the over-presser as an under-presser that is fixed in place.

10. The inserter according to claim 8, wherein at least one of the at least one over-presser and the counter-guide distort the cross-section of the envelope channel selected perpendicular to the movement path of the envelope through the envelope channel.

11. The inserter according to claim 10, wherein the cross-section is partly raised and partly lowered for the distortion.

12. The inserter according to claim 10, wherein the holder comprises a filling aid, wherein the inserter comprises an envelope guide that moves the filling aid along with a plurality of envelopes transported by an envelope transport, and an item transport for feed of the at least one item to the envelopes, and wherein the opener is disposed in a pivot-in region where the filling aid pivots into a respective envelope.

13. The inserter according to claim 12, wherein the envelope transport comprises a suction belt that serves as a down-holder.

14. The inserter according to claim 10, wherein the opener comprises at least one air nozzle.

15. The inserter according to claim 14, wherein the at least one air nozzle is in the at least one over-presser or in the counter-guide.

16. The inserter according to claim 8, wherein the opener further comprises a convex curvature of the envelope channel with reference to the envelope in a movement direction of the envelope.

17. The inserter according to claim 16, wherein the counter-guide is disposed on an outside of the convex curvature, and wherein the counter-guide opens just before an opening region, in a direction away from the envelope channel.

18. The inserter according to claim 17, wherein the counter-guide ends just before the opening region.

19. The inserter according to claim 16, wherein the holder comprises a filling aid, wherein the inserter comprises an envelope guide that moves the filling aid along with a plurality of envelopes transported by an envelope transport, and an item transport for feed of the at least one item to the envelopes, and wherein the opener is disposed in a pivot-in region where the filling aid pivots into a respective envelope.

20. The inserter according to claim 19, wherein the envelope transport comprises a suction belt that serves as a down-holder.

21. The inserter according to claim 16, wherein the opener comprises at least one air nozzle.

22. The inserter according to claim 21, wherein the at least one air nozzle is in the at least one over-presser or in the counter-guide.

23. The inserter according to claim 8, wherein the holder comprises a filling aid, wherein the inserter comprises an envelope guide that moves the filling aid along with a plurality of envelopes transported by an envelope transport, and an item transport for feed of the at least one item to the envelopes, and wherein the opener is disposed in a pivot-in region where the filling aid pivots into a respective envelope.

24. The inserter according to claim 23, wherein the envelope transport comprises a suction belt that serves as a down-holder.

25. The inserter according to claim 8, wherein the opener comprises at least one air nozzle.

26. The inserter according to claim 25, wherein the at least one air nozzle is in the at least one over-presser or in the counter-guide.

27. The inserter according to claim 8, further comprising a down-holder that runs along with the envelope transport.

28. The inserter according to claim 27, wherein the at least one over-presser projects beyond a path of the down-holder.

29. The inserter according to claim 28, wherein the at least one over-presser projects beyond a first envelope cover of a first envelope that is being held down in a direction of a second envelope cover of a second envelope.

* * * * *